United States Patent [19]

Diamond

[11] Patent Number: 4,575,882

[45] Date of Patent: Mar. 18, 1986

[54] INTEGRATED STEREO AND BATHTUB SYSTEM II

[76] Inventor: Harvey E. Diamond, 12953 Woodbridge St., Studio City, Calif. 91604

[21] Appl. No.: 692,827

[22] Filed: Jan. 18, 1985

[51] Int. Cl.[4] ..... A47K 4/00

[52] U.S. Cl. ..... 4/559; 4/661; 128/66

[58] Field of Search ..... 4/559, 661, 638, 546, 4/597, 575, 654, 519, 524, 541; D23/55; D14/20; 455/344, 347, 350; 128/66

[56] References Cited

U.S. PATENT DOCUMENTS

| | | | |
|---|---|---|---|
| D. 169,512 | 5/1953 | Liffmann et al. | D14/20 |
| D. 253,367 | 11/1979 | Weaver | D23/55 |
| D. 278,741 | 5/1985 | Kaiser | D23/55 |
| 1,806,103 | 5/1931 | Tyler | 4/575 |
| 2,958,769 | 11/1960 | Bounds | 455/344 |
| 3,585,991 | 6/1971 | Balamuth . | |
| 3,750,657 | 8/1973 | Lyon | 128/66 |
| 4,025,970 | 5/1977 | Robust | 4/559 |
| 4,114,215 | 9/1978 | Santo | 5/422 |
| 4,277,855 | 7/1981 | Poss | 4/524 |
| 4,340,982 | 7/1982 | Hart et al. | 4/541 |

*Primary Examiner*—Stephen Marcus
*Assistant Examiner*—Lee J. Peters
*Attorney, Agent, or Firm*—I. Morley Drucker

[57] ABSTRACT

A bathtub, and in particular, a whirlpool bathtub or spa, is provided with an upwardly extending surrounding wall portion or surrounding collar at the sitting end of the tub. The collar is preferably formed of plastic as an integral unit with the plastic bathtub wall, and has a plurality of apertures formed therein for the mounting of speakers therein. The speakers, once mounted within the apertures, surround the sitting area of the bathtub. The speaker apertures are placed above the overflow of the bathtub. The speaker apertures are sealed at the rear by a baffle plate, to form one or more acoustic chambers. Overlying the speaker apertures is an open grillwork. The speakers are connected to a sound producing system, such as a radio, tape deck or cassette. The sitting area is thus surrounded by rearwardly enclosed multiple speakers, mounted above the waterline, the speakers being integrated into an upward extension of a bathtub wall by means of the integrally formed speaker apertures. The speakers are further protected by grillwork and drainage channels to minimize contact with water.

12 Claims, 4 Drawing Figures

INTEGRATED STEREO AND BATHTUB SYSTEM II

This application is a continuation-in-part of Ser. No. 688,715 filed Jan. 4, 1985.

BACKGROUND OF THE INVENTION

1. Field of the Invention

The invention relates to a means for integrating a stereophonic or monophonic sound system into a bathtub, and particularly, a whirlpool bathtub or outdoor spa.

2. Description of the Prior Art

The closest prior art known to the applicant are the following patents:

U.S. Pat. No 3,585,991 to Balamuth

U.S. Pat. No. 4,114,215 to Santo

The Balamuth patent discloses a pair of speakers mounted in a headset above a bathtub by means of a hollow pedestal, and connected through the pedestal to a radio, cassette player, or the like. Santos discloses a radio and speaker formed in the bed frame of a waterbed. Neither of these patents discloses a system for achieving a truly integrated stereophonic sound system in an economical, aesthetic and practical manner.

SUMMARY OF THE INVENTION

A bathtub, and in particular, a whirlpool bathtub or spa, is provided with an upwardly extending surrounding wall portion or surrounding collar at the sitting end of the tub. The collar is preferably formed of plastic as an integral unit with the plastic bathtub wall, and has a plurality of apertures formed therein for the mounting of speakers therein. The speakers, once mounted within the apertures, surround the sitting area of the bathtub. The speaker apertures are placed above the overflow of the bathtub.

The speaker apertures are sealed at the rear by a baffle plate, to form one or more acoustic chambers. Overlying the speaker apertures is an open grillwork. The speakers are connected to a sound producing system, such as a radio, tape deck or cassette.

Sloping drainage channels are provided, just below the speaker apertures, to drain water from the vicinity of the speakers back into the bathtub.

The sitting area is thus surrounded by rearwardly enclosed multiple speakers, mounted above the waterline, the speakers being integrated into an upward extension of a bathtub wall by means of the integrally formed speaker apertures. The speakers are further protected by grillwork and drainage channels to minimize contact with water.

DETAILED DESCRIPTION OF THE DRAWINGS

Figure 1:
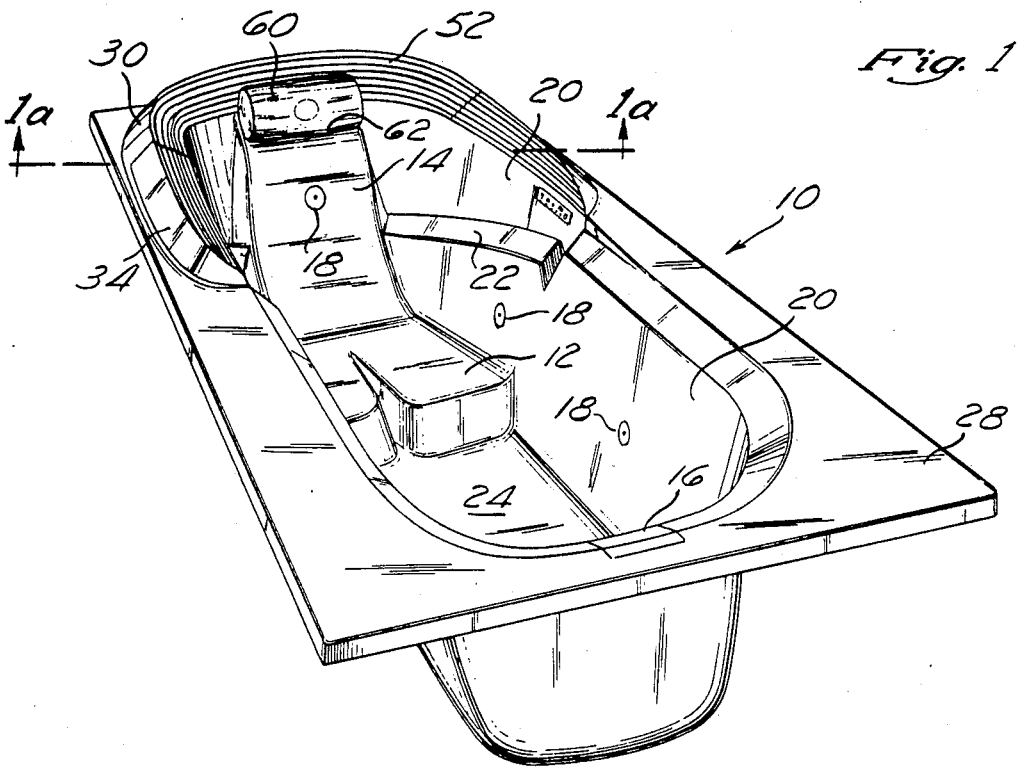
FIG. 1 is a perspective view of the bathtub of my invention.
Figure 3:
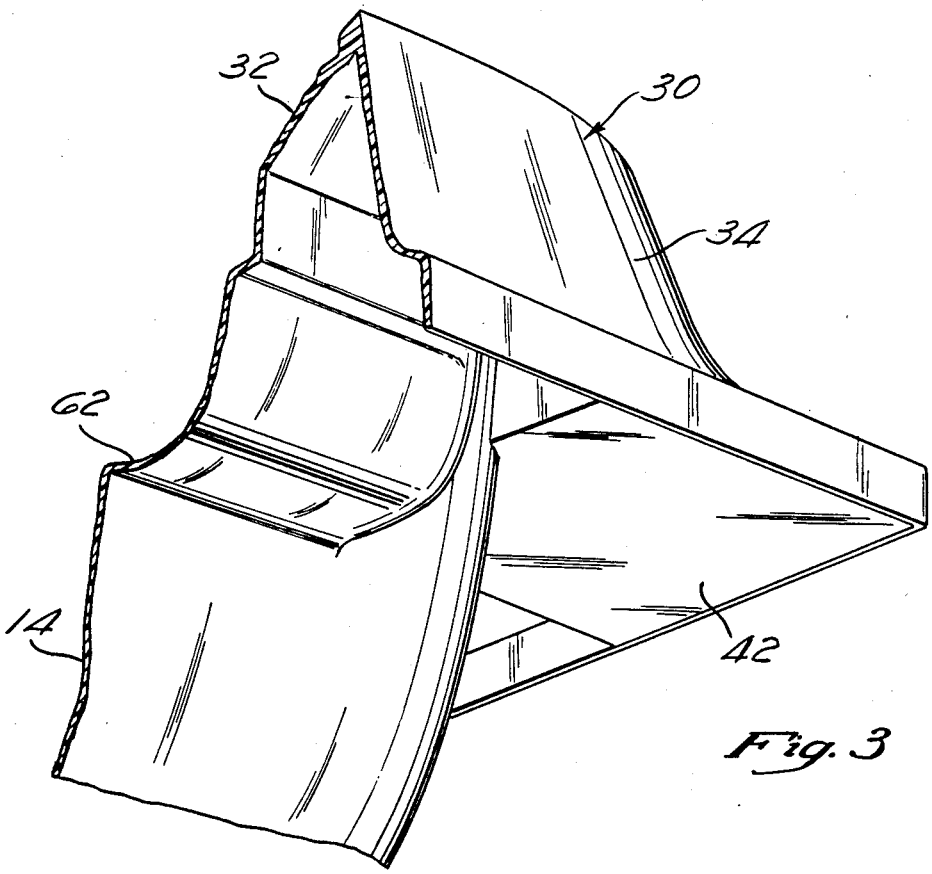
FIG. 3 is a cross-section taken along the line 3—3 of FIG. 1*a*.

The bathtub of my invention is designated generally by the numeral 10. It is provided with a seat 12, a sloping backrest portion 14, an overflow outlet 16, preferably as described in the applicant's copending application, Ser. No. 572,703, filed Jan. 20, 1984, now abandoned, and whirlpool jets 18 which may be of conventional design, and connected to a source of water and air, under pressure. The interior of the bathtub 10 has generally vertical or tapering sidewalls 20, contoured arm rests 22, and a floor 24. The bathtub 10 is formed with a horizontally extending upper rim 28. Overflow outlet 16 is placed near the upper portion of the sidewall 20 and just below rim 28. The bathtub 10 is preferably formed of a moldable plastic resin formulation, which may be conventional in nature, such as multiply fiberglass reinforced polyester resin formulations.

Figure 1A:
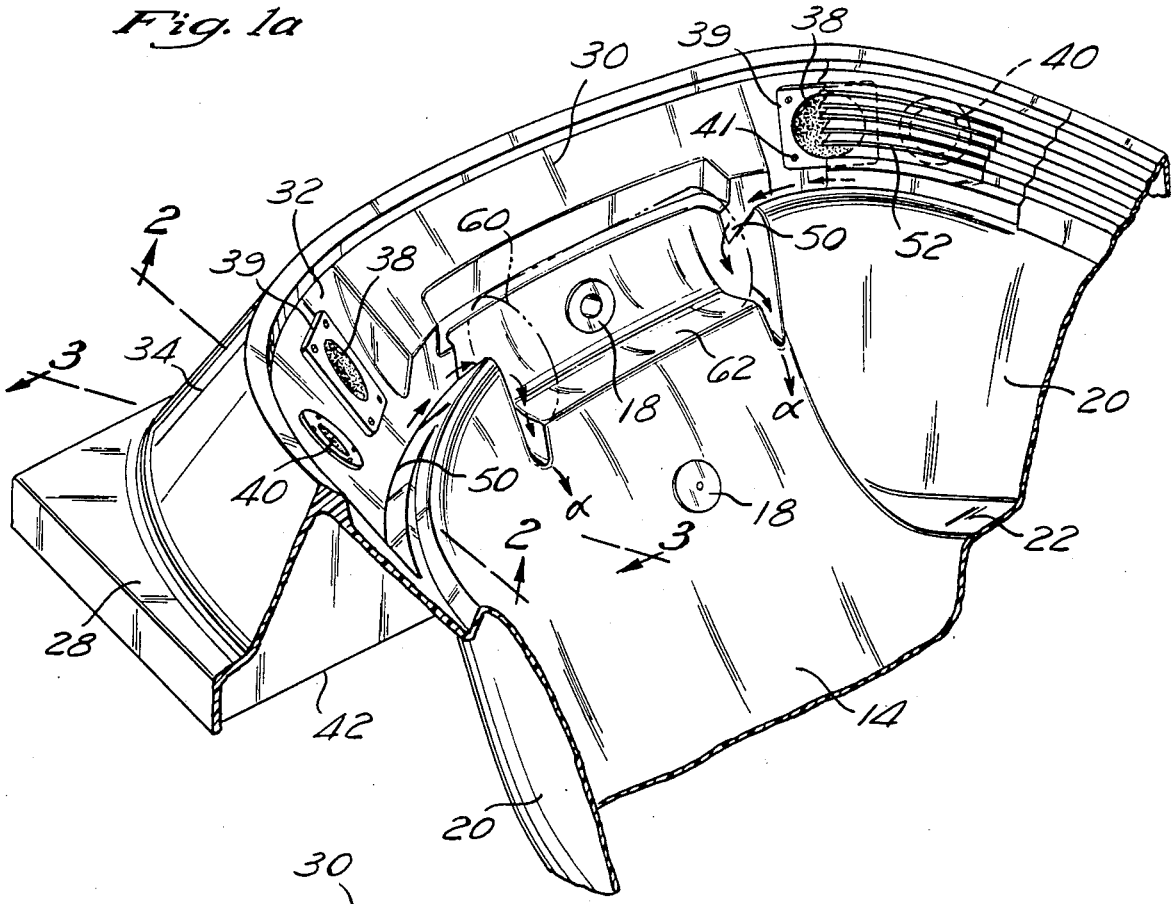
FIG. 1*a* is an enlarged, fragmentary, perspective view, taken generally along the line 1*a*—1*a* of FIG. 1 at the sitting end of the bathtub.
Figure 2:
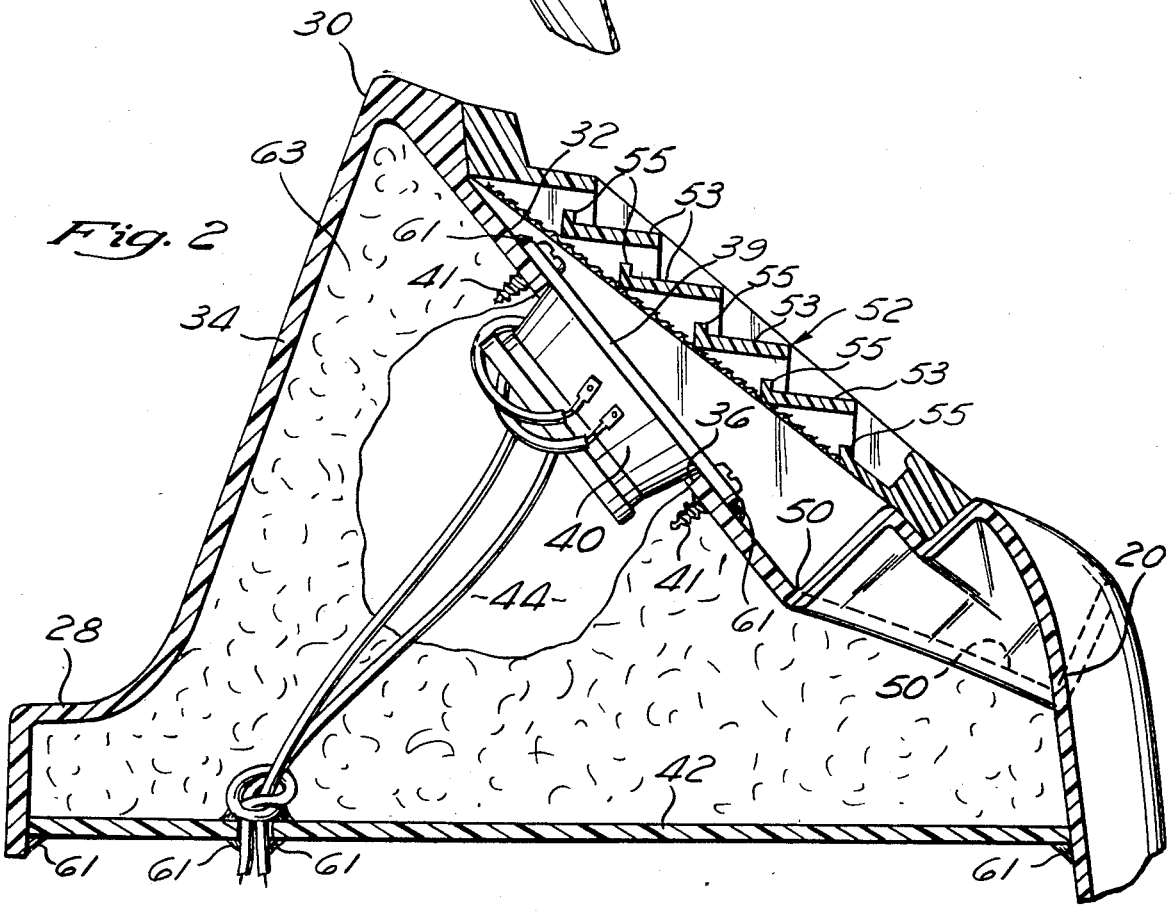
FIG. 2 is a cross-section of the bathtub taken along the line 2—2 of FIG. 1.

Integrally molded to the bathtub wall 20, above the level of the overflow outlet 16 but at the seating end of the bathtub 10, is an upwardly extending wall portion, or collar 30, as best seen in FIGS. 1 and 1*a*. The collar 30 has an upwardly and rearwardly extending interior wall 32. The back wall 34 of collar 30 diverges from interior wall 31 to form, in cross-section, an inverted V, as shown in FIGS. 1*a* and 2.

A cavity means, comprising a plurality of apertures 36, is formed in the interior wall 32 of collar 30, and a pair of speakers 38, 40 are mounted therein, by a conventional mounting plates 39, 40 and screws 41. The speakers 38, 40 are electrically connected to a power source (not shown) in a conventional manner. Speakers 38 may be woofers, whereas speakers 40 may carry the mid-range and/or high frequencies. It is to be noted that the speaker 38, 40 surround the user of the bathtub, who will normally be sitting on seat 12, and reclining against backrest 14. The speakers 38, 40 are preferably spaced eqidistantly about the longitudinal axis of the bathtub 10 in order to create a true stereophonic effect.

The space behind the pair of speakers 38 and 40 is enclosed by means of a baffle plate 42 and sealed around the speakers 39, 40 baffle plate 42 and screws 41 by sealing compound 60 (e.g., silicone based) to create an airtight acoustic chamber 44 to enhance the sound of the speakers. The acoustic chamber 44 is preferably filled with fiberglass insulatin 62 or equivalent.

Downwardly sloping drainage channels 50 are integrally molded into interior wall 32 of collar 30, just below speakers 38, 40 and any water splashing onto, or in the vicinity of, the speakers will be drained therefrom by channels 50, in the direction of the arrows, as shown, and thence into the interior of the bathtub 10.

An open grillwork 52, comprising a series of generally horizontal fins or steps 53 and generally vertical water dams 55 affixed to the inner end of each of the steps 53, overlies the speakers 38, 40 and is supported at the upper and lower ends of the interior wall 32 of collar 30. The grillwork 52 may be hingedly mounted to the wall 32 (not shown) or may merely loosely abut the interior wall32, as shown, for ease of removal. The water dams 55 serve to minimize water intrusion to the speaker area while not impeding movement of sound therethrough.

The user's neck or head preferably rests against a pillow 60, as shown in FIG. 1, which pillow, in turn, rests on a ledge 62 (see FIG. 1) and is in communication with a jet 18, as shown in applicant's copending application, Ser. No. 572,699, filed Jan. 20, 1984, incorporated herein by reference. The water from the channels 50 drains around the ends of pillow 60, as earlier described.

It is to be noted that the tub overflow outlet 16 is in an upper portion of tub wall 20 and that the collar 30, in which the speaker apertures are formed lies above the overflow outlet, so that the normal water level will be below the speakers 38, 40. The collar 30, and the speaker apertures 36 formed therein, are integrally formed or molded with the tub walls 20 and the remainder of the tub 10.

While the preferred embodiment of my invention has been shown and described, modifications therein may be made. I intend therefore to be bound by the scope of the claims which follow.

I claim:

1. In a bathtub adapted to contain a liquid medium and provided with an overflow outlet for said liquid in a first upper wall portion of said bathtub, the improvement which comprises:

a second wall portion of said bathtub extending above said overflow outlet; and a cavity means formed in said second wall portion of said bathtub adapted to enclose at least one speaker of a sound system.

2. The improvements in the bathtub of claim 1 further characterized by:

said first upper wall portion and said second wall portion of said bathtub being formed as an integral unit.

3. The improvements in the bathtub of claim 1 further characterized by:

said first upper wall portion and said second wall portion of said bathtub being formed as an integral unit from a plastic resin formulation.

4. The improvements in the bathtub of claim 1 further characterized by:

a sloping channel means provided below said cavity means for draining liquid from said cavity means into said bathtub.

5. The improvements in a bathtub of claim 4 further characterized by:

said sloping channel means being formed as an integral unit, with said cavity means.

6. The improvements in the bathtub of claim 1 further characterized by:

said bathtub being provided with at least one jet outlet connected to a source of air and water under pressure for the creation of a whirlpool action in said liquid medium adapted to be contained therein.

7. In a bathtub adapted to contain a liquid medium and provided with an overflow outlet for said liquid in a first upper wall portion of said bathtub, the improvement which comprises:

a second wall portion of said bathtub extending above said overflow outlet; and a cavity means formed in said second wall portion of said bathtub adapted to contain at least one speaker of a sound system, said cavity means including a plurality of spaced-apart apertures formed in said second wall portion of said bathtub.

8. In a bathtub adapted to contain a liquid medium and provided with an overflow outlet for said liquid in a first upper wall portion of said bathtub, the improvement which comprises:

a second wall portion of said bathtub extending above said overflow outlet; and a cavity means formed in said second wall portion of said bathtub adapted to contain at least one speaker of a sound system, said cavity means including at least one pair of apertures formed in said second wall portion of said bathtub, each one of said pair of apertures being spaced equidistantly about the longitudinal axis of said bathtub.

9. In a bathtub adapted to contain a liquid medium and provided with an overflow outlet for said liquid in a first upper wall portion of said bathtub, the improvement which comprises:

a second wall portion of said bathtub extending above said overflow outlet;

a cavity means formed in said second wall portion of said bathtub adapted to contain at least one speaker of a sound system; and a baffle means spaced from said cavity means enclosing the rear thereof to form an acoustic chamber behind each of said speakers contained in said cavity means.

10. In a bathtub adapted to contain a liquid medium and provided with an overflow outlet for said liquid in a first upper wall portion of said bathtub, the improvement which comprises:

a second wall portion of said bathtub extending above said overflow outlet;

a cavity means formed in said second wall portion of said bathtub adapted to contain at least one speaker of a sound system; and an open grillwork covering said cavity means.

11. The improvements in the bathtub of claim 9 further characterized by:

a baffle means spaced from said cavity means and enclosing the rear thereof to form an acoustic chamber behind each of said speakers contained in said cavity means, ssaid acoustic chamber being sealed to form an airtight chamber.

12. In a bathtub adapted to contain a liquid medium and provided with an overflow outlet for said liquid in a first upper wall portion of said bathtub, the improvement which comprises:

a second wall portion of said bathtub extending above said overflow outlet;

a cavity means formed in said second wall portion of said bathtub adapted to contain at least one speaker of a sound system; and an open grillwork covering said cavity means, said grillwork comprising a series of generally horizontally extending fins and generally vertically extending dams protruding from each of said fins to minimize water intrusion into said speakers.

* * * * *